US005501581A

United States Patent [19]

Han

[11] Patent Number: 5,501,581

[45] Date of Patent: Mar. 26, 1996

[54] MAGNETIC FLUID PUMP AND A METHOD FOR TRANSPORTING FLUID USING THE SAME

[75] Inventor: Woo-sung Han, Suwon, Rep. of Korea

[73] Assignee: Samsung Electronics Co., Ltd., Suwon, Rep. of Korea

[21] Appl. No.: 394,218

[22] Filed: Feb. 24, 1995

Related U.S. Application Data

[63] Continuation of Ser. No. 121,376, Sep. 15, 1993, abandoned.

[30] Foreign Application Priority Data

Dec. 15, 1992 [KR] Rep. of Korea ..... 92-24364

[51] Int. Cl.[6] ..... F04B 17/00; F04B 35/04

[52] U.S. Cl. ..... 417/415; 417/417; 417/419; 417/53

[58] Field of Search ..... 417/415, 417, 417/419, 53

[56] References Cited

U.S. PATENT DOCUMENTS

| | | | |
|---|---|---|---|
| 2,761,392 | 9/1956 | Parker | 417/417 |
| 3,384,021 | 5/1968 | Perron | 417/417 |
| 3,836,289 | 9/1974 | Wolford et al. | 417/419 |
| 4,416,591 | 11/1983 | Horwinski | 417/417 |

FOREIGN PATENT DOCUMENTS

| | | | |
|---|---|---|---|
| 0207692 | 2/1960 | Austria | 417/417 |
| 1344504 | 10/1962 | France | 417/417 |
| 3033684 | 4/1982 | Germany . | |
| 1608358 | 11/1990 | U.S.S.R. | 417/417 |

*Primary Examiner*—Richard A. Berisch
*Assistant Examiner*—Xuan M. Thai
*Attorney, Agent, or Firm*—Cushman Darby & Cushman

[57] ABSTRACT

A magnetic fluid pump prevents the generation of particles and impurities, and is useful where particles and impurities are to be kept to a minimum, for instance in a resist coating process for manufacturing a semiconductor device. A pair of solenoid coils are wound on the outer surface of both of the ends of a a fluid transporting pipe. Inside the transporting pipe is a magnetic cylinder having a valve attached to one end which opens and closes the fluid path. The magnetic cylinder reciprocates back and forth inside the transfer pipe by changing the current direction of the coils. Fluid can be pumped continuously by reciprocation of the magnetic cylinder. The pump suppresses the generation of particles and impurities. When used in a resist coating process, the formation of a resist pattern having a poor profile during the photolithography processing can be prevented.

11 Claims, 3 Drawing Sheets

MAGNETIC FLUID PUMP AND A METHOD FOR TRANSPORTING FLUID USING THE SAME

This is a continuation of application Ser. No. 8/121,376, filed on Sep. 15, 1993, which was abandoned upon the filing hereof.

BACKGROUND OF THE INVENTION

The present invention relates to a magnetic fluid pump for transporting a fluid and a method for transporting a fluid using the same. More particularly it relates to a magnetic fluid pump which prevents the generation of particles. One use of this invention is described as intaking and discharging a resist solution during the manufacture of a semiconductor device, and a method for transporting a resist solution using the same.

In the process of manufacturing a semiconductor device, small regions of a circuit on a silicon substrate are interconnected with precisely controlled impurities doped thereinto. A resist material is coated on the semiconductor substrate to form a resist film, and the resist film is selectively exposed to an optical source such as an ultraviolet ray, an electronic ray, or an X-ray source. Then, a resist pattern is formed by developing the exposed resist film. The resist pattern remaining after development protects the substrate region which it covers during the various kinds of additive (e.g. lift-off) or subtractive (e.g. etching) processes which are performed on the resist-removed portion of the substrate, thereby affecting the exposed surface of the semiconductor substrate.

Photoresist processing has been automated since the early stages of integrated circuit technology because of the need to form small patterns on a semiconductor wafer. The more recent VLSI processing techniques require the formation of faultless, high-precision small patterns. Specifically, in photoresist processing, it is desirable to automate the process environment because this process is very sensitive to contamination by particles (e.g., hair, etc.). Semiconductor device companies have expended much effort in the development of automated facilities for the various processes, including the photoresist process.

For the coating stage of the photoresist process, a spin-coating method is generally used. The spin-coating method usually comprises securing a semiconductor wafer from the back with a vacuum chuck, and then rotating the wafer at a regular speed while a photoresist solution is dropped onto its surface.

With the development of a wafer stepper, a positive resist which has good resolution is used, but it necessitates higher quality control than previously required. Especially since the positive resist includes various solvent ingredients and polymers, the viscosity changes if it is exposed to air. Therefore, it is more difficult to maintain a uniform film thickness.

In a conventional process for resist coating using a resist coating apparatus, a resist solution in a resist container is syphoned through a hose using a pump, and then transported to the pump through a filter. Thereafter, the resist solution is transported via another hose to be dispensed (or sprayed) through a resist nozzle at the end of the hose onto the semiconductor wafer which is being spun by a rotating chuck. An automatic valve is installed between the pump and the nozzle, thereby automatically regulating the dispensed amount of resist solution.

In the conventional resist coating apparatus, a resist is coated onto a wafer after passing through a pump which is generally a bellows-type pump.

FIG. 1 and FIG. 2 are sectional views showing the operation of the conventional bellows-type pump.

FIG. 1 shows the inletting operation of the conventional bellows-type pump. A conventional bellows-type pump shown in FIGS. 1 and 2 includes a fluid inlet-side frame 4 and a fluid outlet-side frame 9. Fluid inlet-side frame 4 is connected with an inlet pipe 7 and provided with a fluid inlet valve 2. Fluid outlet-side frame 9 is connected with an outlet pipe 6 and provided with a fluid outlet valve 3. Between the pump frames 4 and 9, there is a bellows 1 which interconnects these two frames 4 and 9. FIG. 1 shows that when the bellows 1 is extended, a resist solution 10 is introduced into the pump. The fluid inlet-side frame 4 moves in the direction of the inlet pipe 7 in order to extend the bellows 1. Then, the inlet valve 2 opens and a resist solution 10 enters into the pump through the inlet pipe 7 and fluid inlet valve 2. When this happens, the fluid outlet value 3 is closed by the reduced pressure within the bellows 1.

FIG. 2 shows the operation of outletting resist solution 10, with the conventional bellows-type pump, by closing the bellows 1. When the fluid inlet-side frame 4 is moved toward the fluid outlet-side frame 9, the bellows interior volume is reduced. While the fluid inlet valve 2 is closed and the fluid output valve 3 is open, the resist solution 10 inside the bellows pump exits through the outlet pipe 6.

When the resist coating process is performed by the use of a conventional bellows-type pump, some of the impurities or molecules in the resist solution 10 crystalize, thereby forming particles which accumulate in the recessed portions of the bellows 1. Reference numeral 8 of FIGS. 1 and 2 indicate particles formed by the crystallization of the molecules or impurities of the resist solution which remain in the bellows pump. Over time, the particles 8 mix with the resist solution and exit the pump, thereby contaminating the resist. The resist solution which is then sprayed on the wafer includes particles having a size between hundreds microns and a few microns. These particles degrade the uniformity of the thickness of the resist layer which is formed on the wafer or cause a resist pattern to have a poor profile by acting as impurities in the resist layer in a later exposure or development process.

Additionally, the conventional bellows-type pump is operated by a mechanical movement which becomes unstable over time, and therefore needs to be replaced at regular intervals.

SUMMARY OF THE INVENTION

Accordingly, it is an object of the present invention to provide a novel pump which can suppress the particle formation in the resist coating during semiconductor manufacturing.

Another object of the present invention is to provide a method for transporting a fluid using the pump of this invention.

To accomplish the above objects, the present invention provides a pump comprising a pipe for transporting a fluid from one point to another; at least one electrically conductive coil wound on the outer surface of a section of the pipe for creating a magnetic field inside the pipe; and means for transporting fluid in the pipe along the fluid path due to the force induced by the magnetic field.

According to one embodiment of the present invention, two coils are provided, one at each end of the pipe. The magnetic piston assembly reciprocates between the two ends of the pipe where the coils are wound. The direction of the electrical current in the coils controls the direction of the movement of the piston assembly. By alternating the direction of the current in each coil, thereby alternating the magnetic lines of force, the piston assembly reciprocates inside the pipe between the locations of the two coils. Fluid can thereby be transported by this reciprocation.

The piston assembly ideally comprises a valve which opens and closes during the movement of the transporting means. The piston assembly is preferably a magnetic cylinder comprised of a permanent magnetic material. The magnetic cylinder has a valve at one end and is open at the other end. It is also preferable to form a protective layer on the outer surface of the magnetic cylinder in order to prevent the creation or generation or release of impurities from the outer surface of the magnetic cylinder.

The pipe of the present embodiment consists of a non-magnetic material. Polytetrafluoroethylene, polyvinyl chloride (PVC), stainless steel, bronze and copper are suitable.

The coils are manufactured using a conductive material, such as copper, iron, silver, gold or platinum.

According to the present invention, a fluid can be transported without contamination and without generating impurities, therefore the present invention is ideal for use where a fluid having a high degree of purity is desired. This invention is especially useful for resist coating processes to reduce or suppress the generation of particles or impurities. Therefore, a high quality resist pattern having a good profile can be obtained.

BRIEF DESCRIPTION OF THE DRAWINGS

The above objects and other advantages of the present invention will become more apparent by describing in detail a preferred embodiment thereof with reference to the attached drawings in which.

DESCRIPTION OF THE PREFERRED EMBODIMENT

Hereinafter, the pump and the method for transporting a fluid according to the present invention will be described in detail with reference to the accompanying drawings.

Figure 1:
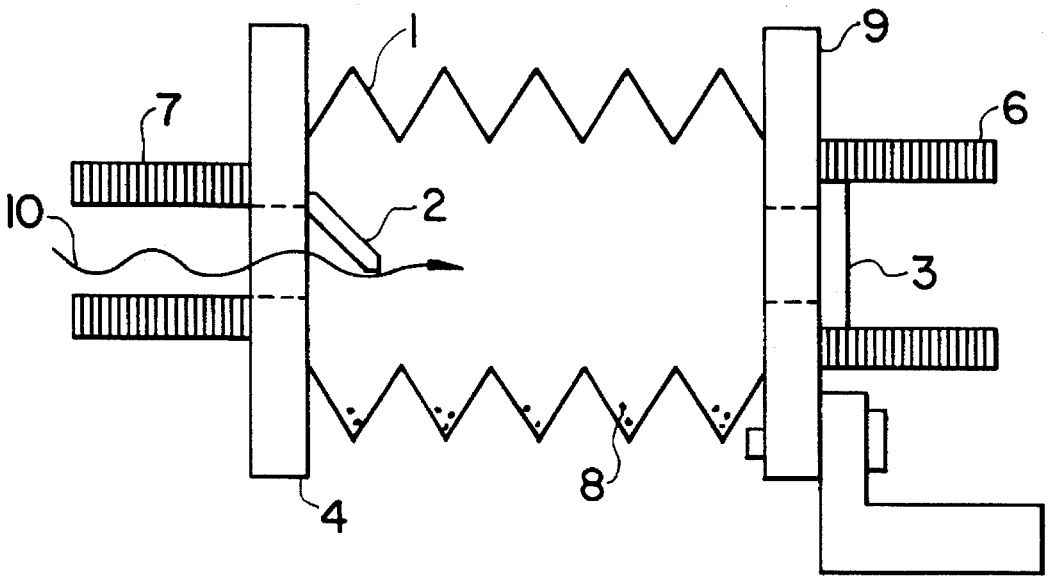
FIG. 1 (PRIOR ART)
FIG. 1 and FIG. 2 are sectional diagrams which show the operation of a conventional bellows-type pump.
Figure 2:
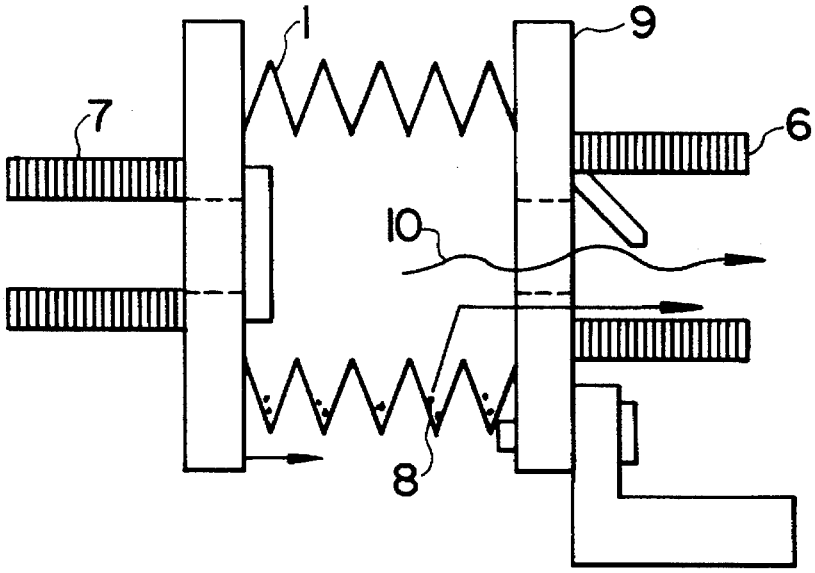
FIG. 2 (PRIOR ART)
Figure 3:
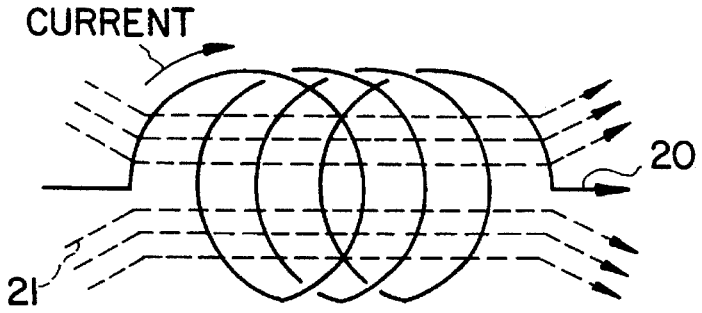
FIG. 3 shows the direction of a magnetic field around a coil according to the indicated direction of the electrical current.

A pump according to the present invention comprises a solenoid, which is a long wire or coil wound in a close-packed helix and carrying a current, thereby generating a magnetic field. FIG. 3 shows the direction of the magnetic field generated by a solenoid with electrical current flowing in the coil. The direction of the magnetic force is easily determined using the right-hand rule.

FIG. 3 shows magnetic field lines densely formed inside the radius of the solenoid according to the direction of the electrical current driven through the coil 20. Reference numeral 21 indicates the direction of the magnetic field. Here, the end where the current enters the coil acts as a magnetic South pole and the end where the current exits the coil acts as a magnetic North pole. Thus, an electromagnet having two poles is obtained.

Figure 4:
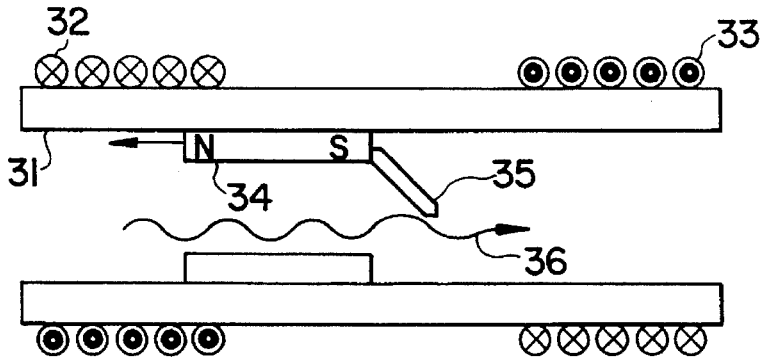
FIG. 4 and FIG. 5 are sectional views showing the operation of a pump according to one embodiment of the present invention.
Figure 5:
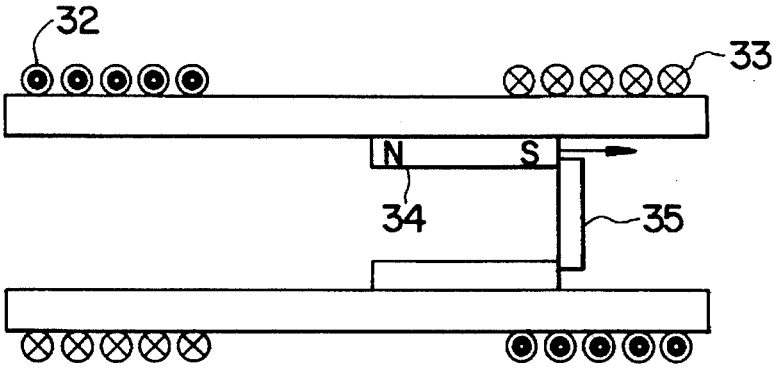

FIG. 4 and FIG. 5 are sectional views showing the operation of the pump according to one embodiment of the present invention.

Reference numeral 31 designates a transporting pipe for transporting a fluid from one point along the pipe to another. A first coil 32 forms a first solenoid, wound on the outer surface of one end of a predetermined section of the transporting pipe 31. A second coil 33 forms a second solenoid, wound on the outer surface of an opposite end of the predetermined section of transporting pipe 31. As shown in the drawings, a magnetic cylinder 34 having a South pole and a North pole is made of a permanent magnetic material. The magnetic cylinder 34 is inside of the transporting pipe 31. A valve 35 opens and closes a fluid path on one end of the magnetic cylinder 34. The other end of the cylinder is open. The valve 35 is constructed in this embodiment on the outlet side of the magnetic cylinder.

FIG. 4 illustrates the step of moving the magnetic cylinder 34 to intake fluid. An electric current is sent in one coil 32 in one direction with an electrical current of a first polarity with respect to the coil 32, while the other coil 33 is driven in the opposite direction with an electrical current of a second polarity opposite the electrical current of the first polarity, with respect to the coil 33. Note that reversing the direction of the coil windings would be equivalent to reversing the direction of the current between electrical currents of first and second polarities in the coil.

The left side of the first solenoid is N-polarized and the right side is S-polarized, while the left side of the second solenoid is S-polarized and the right side is N-polarized, thereby forcing the magnetic cylinder 34 toward the left coil 32. When the magnetic cylinder 34 moves to the left valve 35 opens and fluid in the transport pipe passes through.

FIG. 5 shows the magnetic cylinder 34 moving to the right. After the magnetic cylinder 34 has moved a predetermined distance to the left, currents in coil 32 and coil 33 are reversed by changing the current in coil 32 to an electrical current of a second polarity and by changing the current in coil 33 to an electrical current of a first polarity. Thereafter, the left side of the first solenoid is S-polarized, and the right side is N-polarized, while the left side of the second solenoid is N-polarized and the right side is S-polarized. As a result, the magnetic cylinder 34 moves toward the right coil 33. Valve 35 is closed, and the cylinder 34 forces resist material to the right. A vacuum is created which pulls fluid into the magnetic cylinder 34.

In the present embodiment, the first and second solenoids are formed on the outer surface of a predetermined section of transporting pipe 31. However, especially if the distance of movement of the magnetic cylinder 34 is short, the pump can be manufactured using only a single solenoid. As shown in the present embodiment, the distance of movement of the magnetic cylinder 34 can be lengthened by extending the distance between the coils 32 and 33.

Additionally, two protruding portions or "stops" (not shown) can be formed inside of the fluid transporting pipe 31 in order to restrict the movement of the magnetic cylinder 34. This would then enable the magnetic cylinder 34 to reciprocate only between the protruding portions.

A resist solution 36 can be transported continuously through the transporting pipe 31 by continuously repeating the steps of FIG. 4 and FIG. 5.

Figure 6:
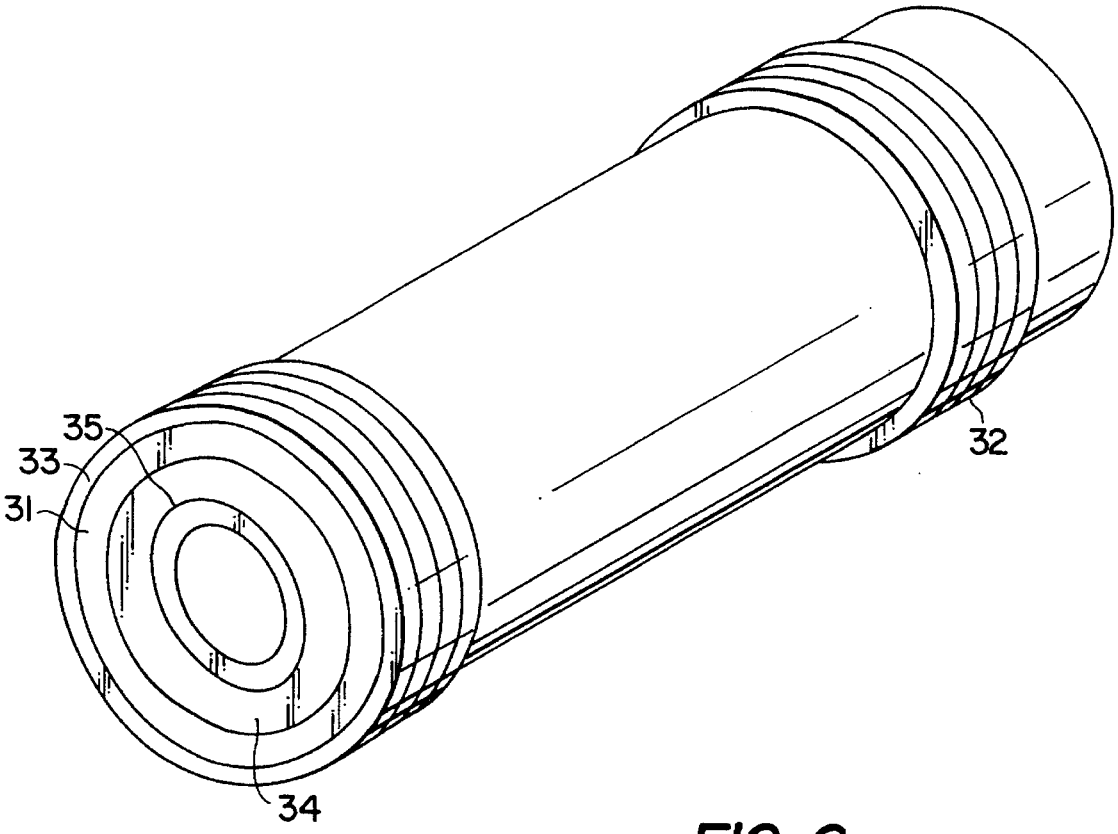
FIG. 6 is a perspective view of a cylindrical fluid pump which is an embodiment of the present invention.

FIG. 6 is a perspective view showing a cylindrical fluid pump as an example of the magnetic fluid pump of the present invention.

In this preferred embodiment, a solenoid is formed at each end of a predetermined section of a cylindrical transporting pipe 31, preferably within 2 to 8 cm of each other, and preferably having an inside diameter of between 0.5 and 3 inches. The coils 32 and 33 have a diameter of between 0.5 and 3 mm, and are wound approximately 10 to 30 times around the transport pipe. As was illustrated in FIGS. 4 and 5 of a previous embodiment, a magnetic cylinder 34, made of a permanent magnetic material and having an outside diameter smaller than the inside diameter of the transporting pipe 31 and a length of 0.5 to 4 cm, is inside the transporting pipe 31. A valve 35 which can open and close the fluid path is at one end of the magnetic cylinder 34. The transporting pipe 31 is made of nonmagnetic materials, such as polytetrafluoroethylene, polyvinyl chloride (PVC), stainless steel, bronze and/or copper, while coils 32 and 33 are made of such conductive material as Cu, Fe, Ag, Au and/or Pt. It is preferable to use enameled wire for coils 32 and 33. The diameter of coils 32 and 33 depends upon the size of the outside diameter of the transporting pipe 31, the magnetic strength of the permanent magnetic material used for the magnetic cylinder 34, and the density of the current flowing through the coils 32 and 33. For the present embodiment the magnetic cylinder 34 is reciprocated by alternatively applying a direct-current, such as ±24 volts, in regular intervals.

When a fluid requiring a high degree of purity is pumped, such as a photoresist that is used in the lithography process of the semiconductor manufacturing process, it is desirable that the transporting pipe 31 and the magnetic cylinder 34 be kept clean. To further prevent particle generation and/or accumulation from damaging the transporting pipe 31 and magnetic cylinder 34 due to the friction therebetween, magnetic cylinder 34 is preferably coated with a protective layer comprised of a material such as polytetrafluoroethylene.

Performing a resist coating process using the fluid pump according to the present invention suppresses generation of particles and impurities, thereby resulting in the reduction of impurities and particles in the pumped resist fluid. Accordingly, a uniform and small resist pattern can be formed on a semiconductor device.

While the present invention has been shown and described with reference to particular embodiments thereof, it is to be understood by those skilled in the art that various changes in the form and details may be effected therein without departing from the spirit and scope of the invention as defined by the appended claims.

What is claimed is:

1. A pump comprising:

a pipe;

a first coil formed on a first outer surface of a first predetermined section of said pipe;

a second coil formed on a second outer surface of a second predetermined section of said pipe apart from said first predetermined section of said pipe;

a single reciprocatable hollow cylinder having an outer cylindrical surface, said single reciprocatable hollow cylinder including:

an entire outer cylindrical surface of said single reciprocatable hollow cylinder being in close tolerance contact with an inner cylindrical surface of said pipe to prevent at least one of particle generation and particle accumulation between said inner cylindrical surface of said pipe and said outer cylindrical surface of said single reciprocatable hollow cylinder, and a single valve which opens and closes a fluid path at an outlet of said single reciprocatable hollow cylinder; and said single reciprocatable hollow cylinder being reciprocated in said pipe by an application of a first electrical current to said first coil and said second coil, followed by an application of a second electrical current opposite said first electrical current, to said first coil and said second coil.

2. A pump according to claim 1, wherein said protective layer is a layer of polytetrafluoroethylene.

3. A pump according to claim 1, wherein said pipe comprises a non-magnetic material.

4. A pump according to claim 3, wherein said non-magnetic material is any one selected from the group consisting of polytetrafluoroethylene, polyvinyl chloride (PVC), stainless steel, bronze and copper.

5. A pump according to claim 1, wherein said first coil is comprised of a conductive material selected from the group consisting of Cu, Fe, Ag, Au and Pt.

6. A method for transporting a resist fluid comprising the steps of:

introducing said resist fluid into a pipe, said pipe containing a single movable hollow cylinder of permanent magnetic material, said movable hollow cylinder including a valve, and a protective layer on an outer cylinder surface of said movable hollow cylinder, said pipe having a first coil and a second coil wrapped therearound and separated by a predetermined distance, said first coil and said second coil for forming a magnetic field;

supplying said first coil and said second coil with a first direct electrical current for a first predetermined time thereby moving said single movable hollow cylinder in a first direction along a length of said pipe; and then supplying said first coil and said second coil with a second direct electrical current opposite said first direct electrical current, for a second predetermined time, thereby moving said single movable hollow cylinder in a second direction opposite said first direction.

7. A pump comprising:

a pipe;

a first coil formed on a first outer surface of a first predetermined section of said pipe;

a second coil formed on a second outer surface of a second predetermined section of said pipe apart from said first predetermined section of said pipe;

a single reciprocatable hollow cylinder having an outer cylindrical surface, said single reciprocatable hollow cylinder including:

an entire outer cylindrical surface of said single reciprocatable hollow cylinder being in close tolerance contact with an inner cylindrical surface of said pipe to prevent at least one of particle generation and particle accumulation between said inner cylindrical surface of said pipe and said outer cylindrical surface of said single reciprocatable hollow cylinder, and a single valve which opens and closes a fluid path at an outlet of said single reciprocatable hollow cylinder; and said single reciprocatable hollow cylinder being reciprocated in said pipe by an application of a first DC electrical current to said first coil and said second coil, followed by an application of a second DC electrical current opposite said first electrical current, to said first coil and said second coil.

8. A pump according to claim 7, wherein said protective layer is a layer of polytetrafluoroethylene.

9. A pump according to claim 7, wherein said pipe comprises a non-magnetic material.

10. A pump according to claim 9, wherein said non-magnetic material is any one selected from the group consisting of polytetrafluoroethylene, polyvinyl chloride (PVC), stainless steel, bronze and copper.

11. A pump according to claim 7, wherein said first coil is comprised of a conductive material selected from the group consisting of Cu, Fe, Ag, Au and Pt.

* * * * *